US009358475B2

(12) United States Patent
Michalowski et al.

(10) Patent No.: US 9,358,475 B2
(45) Date of Patent: Jun. 7, 2016

(54) ROBOT

(71) Applicant: Beatbots, LLC, San Francisco, CA (US)

(72) Inventors: Marek P. Michalowski, San Francisco, CA (US); Gregory R. Katz, San Francisco, CA (US); Thiago G. Hersan, Pittsburgh, PA (US); Alea C. Teeters, Daly City, CA (US)

(73) Assignee: BEATBOTS, LLC, San Francisco, CA (US)

( * ) Notice: Subject to any disclaimer, the term of this patent is extended or adjusted under 35 U.S.C. 154(b) by 0 days.

(21) Appl. No.: 14/568,821

(22) Filed: Dec. 12, 2014

(65) Prior Publication Data

US 2015/0165336 A1 Jun. 18, 2015

Related U.S. Application Data

(60) Provisional application No. 61/915,249, filed on Dec. 12, 2013.

(51) Int. Cl.

| | |
|---|---|
| ***A63H 13/18*** | (2006.01) |
| ***A63H 29/22*** | (2006.01) |
| ***A63H 13/00*** | (2006.01) |
| ***A63H 3/40*** | (2006.01) |
| ***A63H 15/06*** | (2006.01) |

(52) U.S. Cl.

CPC ..... *A63H 29/22* (2013.01); *A63H 3/40* (2013.01); *A63H 13/00* (2013.01); *A63H 15/06* (2013.01); *Y10S 901/46* (2013.01); *Y10S 901/48* (2013.01)

(58) Field of Classification Search

USPC ..... 446/273–275, 279, 280, 286–288, 446/324–326, 330, 351, 353, 379, 431, 457

See application file for complete search history.

(56) References Cited

U.S. PATENT DOCUMENTS

| | | | | |
|---|---|---|---|---|
| 1,763,903 | A * | 6/1930 | Perkins | A63H 7/04 446/273 |
| 3,798,835 | A * | 3/1974 | McKeehan | A63H 33/005 446/442 |
| 4,005,545 | A * | 2/1977 | Ptaszek | A63H 3/40 446/341 |
| 4,501,569 | A * | 2/1985 | Clark, Jr. | A63H 33/005 180/21 |
| 5,720,644 | A * | 2/1998 | Ku | A63H 11/00 446/175 |
| 6,347,261 | B1 | 2/2002 | Sakaue et al. | |
| 6,373,265 | B1 | 4/2002 | Morimoto et al. | |
| 6,569,025 | B1 * | 5/2003 | Tyler | A63B 37/0001 446/454 |
| 7,258,591 | B2 * | 8/2007 | Xu | A63H 33/26 446/273 |
| 8,099,189 | B2 * | 1/2012 | Kaznov | A63H 11/00 318/568.12 |
| 8,764,656 | B2 | 7/2014 | Shin et al. | |
| D714,881 | S | 10/2014 | Michalowski et al. | |
| D714,883 | S | 10/2014 | Michalowski et al. | |

(Continued)

*Primary Examiner* — Nini Legesse

(74) *Attorney, Agent, or Firm* — K&L Gates LLP

(57) ABSTRACT

A robot is disclosed. The robot can comprise a body comprising a curved base and a multi-directional center of mass shifter assembly positioned within the body. The multi-directional center of mass shifter assembly can comprise a weight, a first actuator drivingly coupled to the weight, and a second actuator drivingly coupled to the first actuator. Actuation of the first actuator can be configured to rotate the weight relative to a first axis, and actuation of the second actuator can be configured to rotate the weight relative to a second axis, which is transverse to the first axis. The robot can comprise an inertial measurement unit, a controller, and/or an eye movable relative to the body. The position of the eye can be adjusted by an eye actuation assembly.

14 Claims, 12 Drawing Sheets

(56) References Cited

U.S. PATENT DOCUMENTS

| | | | | |
|---|---|---|---|---|
| D714,888 | S | 10/2014 | Kasznica et al. | |
| 9,002,768 | B2 | 4/2015 | Fedorov | |
| 9,207,755 | B2 | 12/2015 | Byrnes et al. | |
| 9,224,273 | B1 | 12/2015 | Atkinson et al. | |
| 2013/0231029 | A1* | 9/2013 | Katz | A63H 30/02 446/454 |
| 2014/0371954 | A1 | 12/2014 | Lee et al. | |
| 2015/0100157 | A1 | 4/2015 | Houssin et al. | |
| 2015/0165625 | A1 | 6/2015 | Michalowski et al. | |
| 2015/0277617 | A1 | 10/2015 | Gwin et al. | |

* cited by examiner

ROBOT

CROSS-REFERENCE TO RELATED APPLICATION

This application claims the benefit under 35 U.S.C. §119 (e) of U.S. Provisional Patent Application No. 61/915,249, entitled ROBOT, filed Dec. 12, 2013, which is incorporated by reference herein in its entirety.

TECHNICAL FIELD

The present disclosure relates to robots, which can be used as toys and/or in research, for example, and systems and methods for using and creating such robots.

BACKGROUND

In at least one embodiment, the present disclosure provides a mechanism and/or system to move the body of a robot in an attractive or entertaining manner.

In at least one embodiment, the present disclosure provides a mechanism and/or system to move the body of a robot laterally across a surface without the use of wheels or legs.

In at least one embodiment, the present disclosure provides a mechanism and/or system to move the eyes of a robot with expression.

In at least one embodiment, the present disclosure provides a method and/or system for an interactive robot to respond expressively to the movement of its body.

The foregoing discussion is intended only to illustrate various aspects of certain embodiments disclosed in the present disclosure, and should not be taken as a disavowal of claim scope.

BRIEF DESCRIPTION OF THE DRAWINGS

Various features of the embodiments described herein are set forth with particularity in the appended claims. The various embodiments, however, both as to organization and methods of operation, together with the advantages thereof, may be understood in accordance with the following description taken in conjunction with the accompanying drawings as follows:

The exemplifications set out herein illustrate various embodiments, in one form, and such exemplifications are not to be construed as limiting the scope of the appended claims in any manner.

DETAILED DESCRIPTION

Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and illustrative. Variations and changes thereto may be made without departing from the scope of the claims.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

The present disclosure relates to a novel and unique mobile robot. In certain instances, the present disclosure relates to an interactive mobile robot that can rock in a controlled manner under its own power. In various instances, the present disclosure relates to an interactive mobile robot that can generate secondary movements that are appropriate either to its own self-generated movement or to externally-applied movement.

For example, the eyes and/or appendages extending from the body of the robot can be configured to move.

Figure 1:
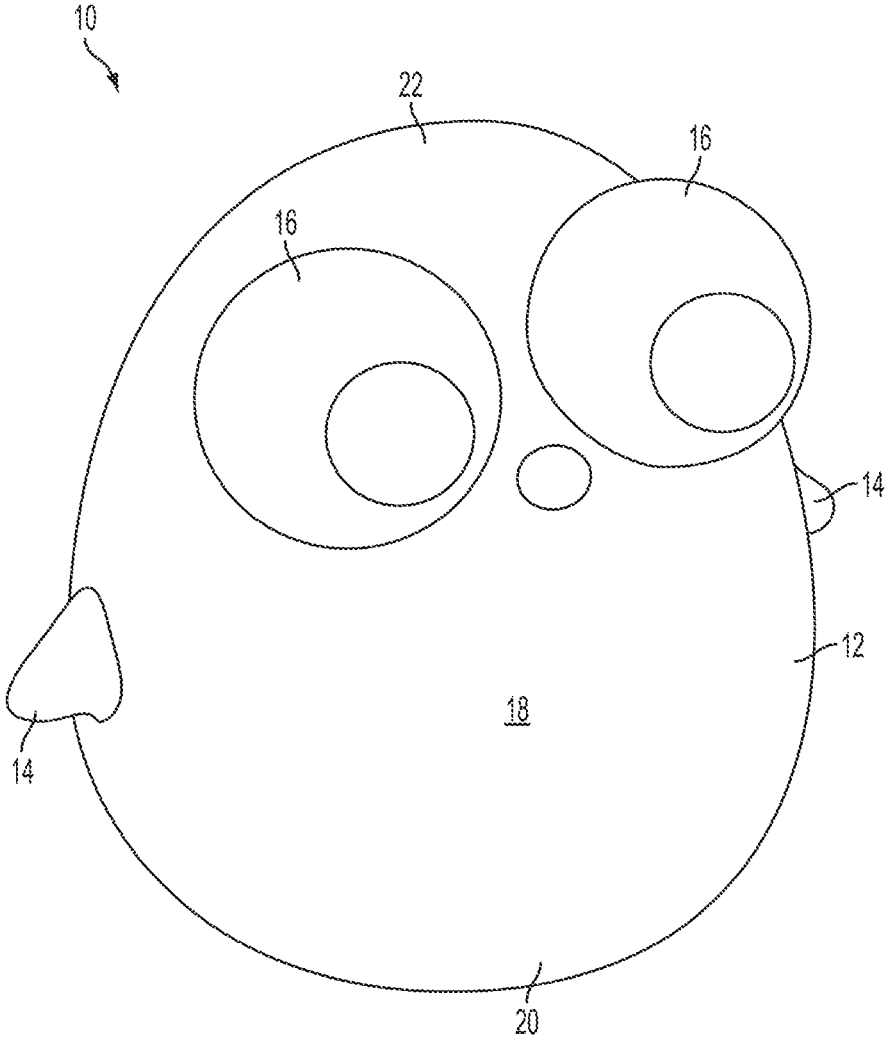
FIG. 1 is a perspective view of a robot including a body, appendages, and eyes, according to various embodiments of the present disclosure.
Figure 2:
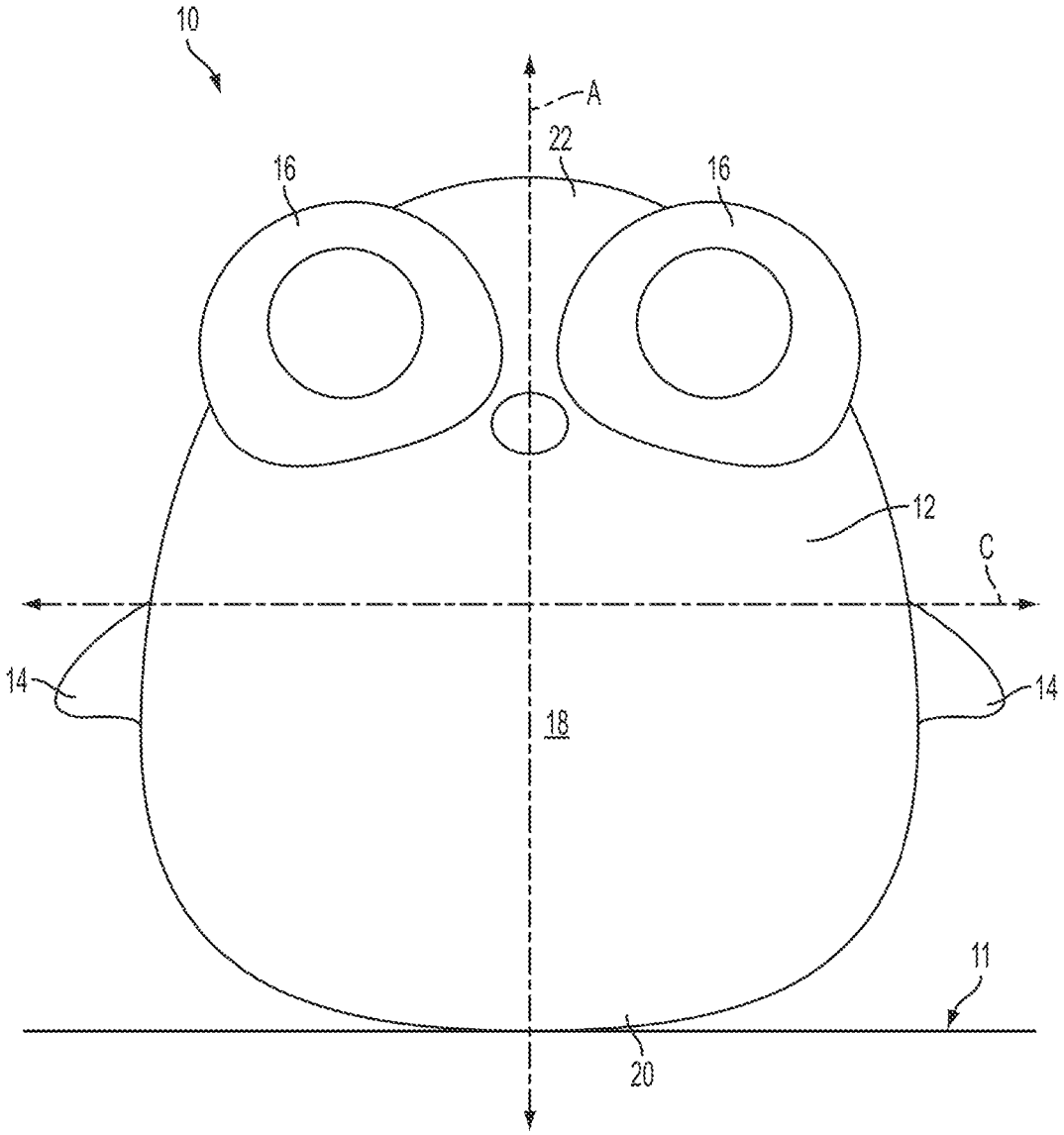
FIG. 2 is an elevation view of the robot of FIG. 1, according to various embodiments of the present disclosure.
Figure 3:
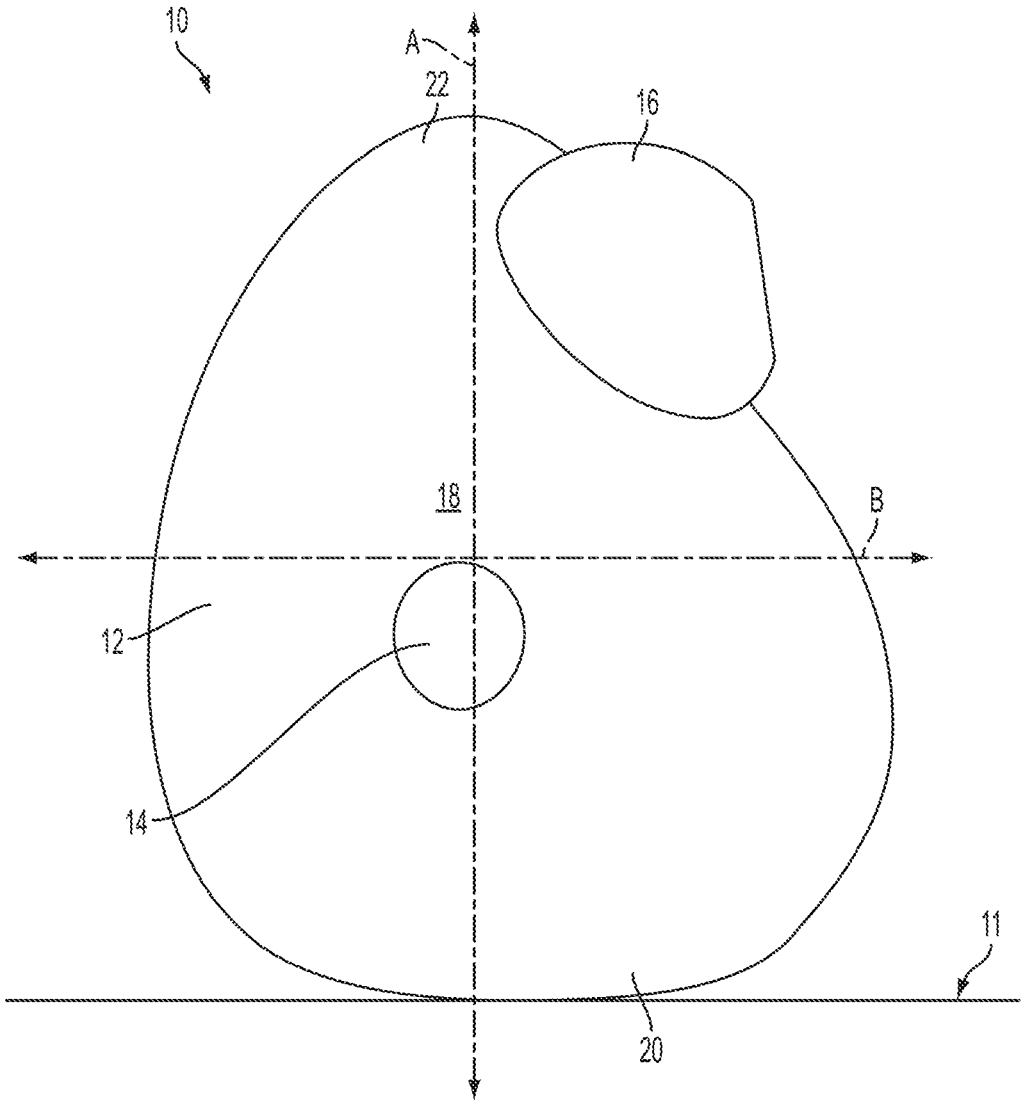
FIG. 3 is another elevation view of the robot of FIG. 1, according to various embodiments of the present disclosure.

Referring primarily to FIGS. 1-3, a robot 10 is depicted. The robot 10 includes a body 12, appendages or arms 14 extending from the body 12, and eyes 16 supported on the body 12, for example. A shell or skin 18 can define the perimeter of the body 12. As described in greater detail herein, the shell 18 can define an inner cavity 32 (FIG. 4), which can house various internal components of the robot 10.

The reader will appreciate that the robot 10 depicted in FIGS. 1-3 does not include legs or feet to support the robot 10 on a support surface 11 (FIGS. 2 and 3). Rather, as depicted in FIGS. 1-3, the body 12 comprises a rounded and/or contoured posterior end 20. Such a rounded posterior end 20 can form a base and/or bottom surface for the body 12. In various instances, the posterior end 20 can be placed in contact with a flat, or substantially flat, support surface 11 (FIGS. 2 and 3) upon which the robot 10 can sit. An anterior end 22 can be opposite or substantially opposite to the posterior end 20, and can be positioned vertically upright from the posterior end 20 when the robot 10 is balanced and/or at equilibrium.

The reader will further appreciate that the robot 10 can comprise various different shapes and/or styles. For example, the robot 10 can comprise a toy, such as the robotic toys disclosed in U.S. Design Pat. No. D714,881, to Michalowski et al., which issued on Oct. 7, 2014, and is hereby incorporated by reference herein in its entirety. In various instances, the robot 10 can include additional features, such as additional facial features and/or body parts. Additionally or alternatively, the robot 10 can include various colors and/or designs. In certain instances, the robot 10 can include additional systems and components, such as those disclosed in contemporaneously-filed U.S. patent application Ser. No. 14/568,846, entitled ROBOT, now U.S. Patent Application Publication No. 2015-0165625, which is hereby incorporated by reference herein in its entirety. The following robotic toys are also incorporated by reference herein in their respective entireties: U.S. Design Pat. No. D714,883, entitled ROBOT, which issued on Oct. 7, 2014 and U.S. Design Pat. No. D714,888, entitled ROBOT, which issued on Oct. 7, 2014.

Figure 4:
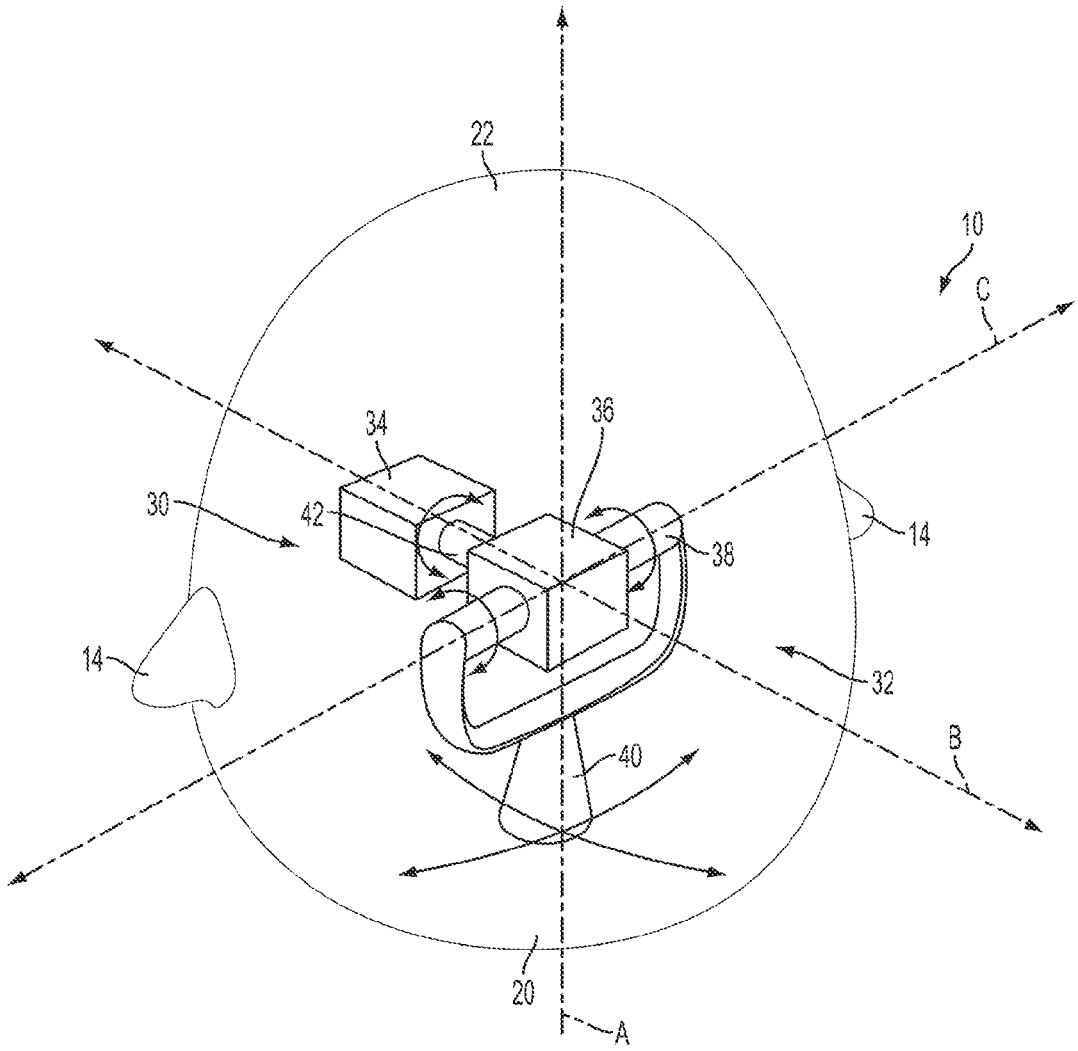
FIG. 4 is a perspective view of the robot of FIG. 1 with various elements shown in transparency and various elements removed for illustrative purposes, depicting a multi-directional center of mass shifter assembly positioned within the body, according to various embodiments of the present disclosure.

Referring now to FIG. 4, for illustrative purposes, the shell 18 (FIGS. 1-3) of the body 12 is depicted in transparency to show various components and systems positioned within the body 12 of the robot 10. For example, a multi-directional center of mass shifter assembly 30 is depicted within the shell 18 of the body 12. As described herein, the center of mass shifter assembly 30 can be configured to shift the center of mass of the body 12 of the robot 10 to affect movement of the robot 10 across the support surface 11 (FIGS. 2 and 3).

The center of mass shifter assembly 30 can be mounted and/or supported within the body 12. For example, the body 12 can include a frame, which can be internal to the shell 18. In various instances, the frame can support the shell 18. The center of mass shifter assembly 30 can be attached and/or secured to the frame of the body 12. In certain instances, the frame can include a top beam and/or cross-bar positioned at the top and/or anterior end 22 of the body 12. The shifter assembly 30 can be suspended from such a top beam and/or cross-bar, for example. More particularly, a support bar can extend downward from the frame to the shifter assembly 30 such that the shifter assembly 30 is suspended within the cavity 32 defined by the frame. In certain instances, the frame and/or support bar can be comprised of a rigid, or substantially rigid, material.

If external forces are applied to the robot 10 causing the robot 10 to shift and/or tilt, the robot 10 can be configured to return to an upright orientation. For example, if the robot 10 is tilted and/or rocked along the dorsoventral axis B (FIGS. 3 and 4), e.g., forward and/or backward, and/or the lateral axis C (FIGS. 2 and 4), e.g., side-to-side, the robot 10 can be configured to return to the upright orientation. In the upright orientation, the anterior end 22 can be positioned above the posterior end 20. For example, the ends 20, 22 can be vertically aligned, and the anterior end 22 can be stacked above the posterior end 20. As depicted in FIGS. 2 and 3, when in the upright orientation, the anteposterior axis A extending between the ends 20, 22 can be perpendicular to the support surface 11. In various instances, the robot 10 can be weighted such that the body 12 rights itself and returns to the vertical and/or upright orientation when external forces are applied to the robot 10.

Referring still to the embodiment depicted in FIG. 4, the volume within the posterior end 20 of the robot 10 defines at least a portion of the hollow cavity 32, which houses the multi-directional center of mass shifter assembly 30. More particularly, the center of mass shifter assembly 30 includes a weight 40 that is suspended from a set of two gimbals or actuators 34 and 36 within the cavity 32. In other words, the center of mass shifter assembly 30 can form a driven pendulum, wherein the weight 40 is driven by the actuators 34 and 36. The first actuator 34 can be supported by the frame of the body 12, and the second actuator 36 can be supported by the first actuator 34. Moreover, the weight 40 can be supported by the second actuator 36 such that both actuators 34 and 36 are intermediate the frame of the body 12 and the weight 40. In various instances, the actuators 34 and 36 can include a position-controllable motor. For example, each actuator 34 and 36 can include a stepper motor or servo motor. In at least one embodiment, the actuators 34 and 36 can be implemented with a Mercury stepper motor (SM-42BYG011-25).

In various instances, the weight 40 can be configured to bias the robot 10 into the upright and/or vertical orientation depicted in FIGS. 1-4. For example, when external forces are removed and gravity is the sole force acting on the robot 10, the weight 40 can be pulled into alignment with the anteposterior axis A extending between the posterior end 20 and the anterior end 22 of the robot 10. Referring primarily to FIG. 4, gravity can pull the weight 40 into alignment with the anteposterior axis A of the body 12, which can draw the robot 10 into the upright orientation. As a result, the robot 10 can be configured to return to the upright orientation from the rotated, tilted, and/or rocked orientation.

Referring still to FIG. 4, a first output shaft 42 extends from the first actuator 34. Actuation of the first actuator 34 is configured to rotate the first output shaft 42 about the dorsoventral axis B, which is aligned with the first output shaft 42. The first output shaft 42 can be positioned intermediate the first actuator 34 and the second actuator 36. For example, the first output shaft 42 can extend from the first actuator 34 to the second actuator 36. The output motion from the first actuator 34 can be transferred to the second actuator 36 via the first output shaft 42. For example, actuation of the first actuator 34 can affect rotation of the first output shaft 42 and corresponding rotation of the second actuator 36 about the dorsoventral axis B. Moreover, as described herein, actuation of the first actuator 34 can further affect rotation of the weight 40 about the dorsoventral axis B, thus moving the weight 40 side-to-side along the lateral axis C and up and/or down along the anteposterior axis A.

Referring still to FIG. 4, a second output shaft 38 can extend from the second actuator 36, and actuation of the second actuator 36 is configured to rotate the second output shaft 38 relative to the lateral axis C, which is aligned with the second output shaft 38. The weight 40 is coupled to the second output shaft 38 of the second actuator 36. For example, the weight 40 can be coupled to two ends of the second output shaft 38 on either side of the second actuator 36 via a U-shaped support and/or bracket. In various instances, the weight 40 can symmetrically extend from the second actuator 36, such that the weight 40 is balanced. In other instances, the weight 40 can be unbalanced relative to the second actuator 36 and/or the first actuator 34. In various instances, the second actuator 36 can affect rotation of the weight 40 around the lateral axis C. For example, actuation of the second actuator 36 can affect rotation of the second output shaft 38 and the weight 40 coupled thereto, thus moving the weight 40 forward and/or backward along the dorsoventral axis B and up and/or down along the anteposterior axis A. Accordingly, the system of actuators 34, 36 in the center-of-mass shifter assembly 30 can be configured to move the weight side-to-side, up, down, forward and/or backward within the three-dimensional cavity 32.

Figure 12:
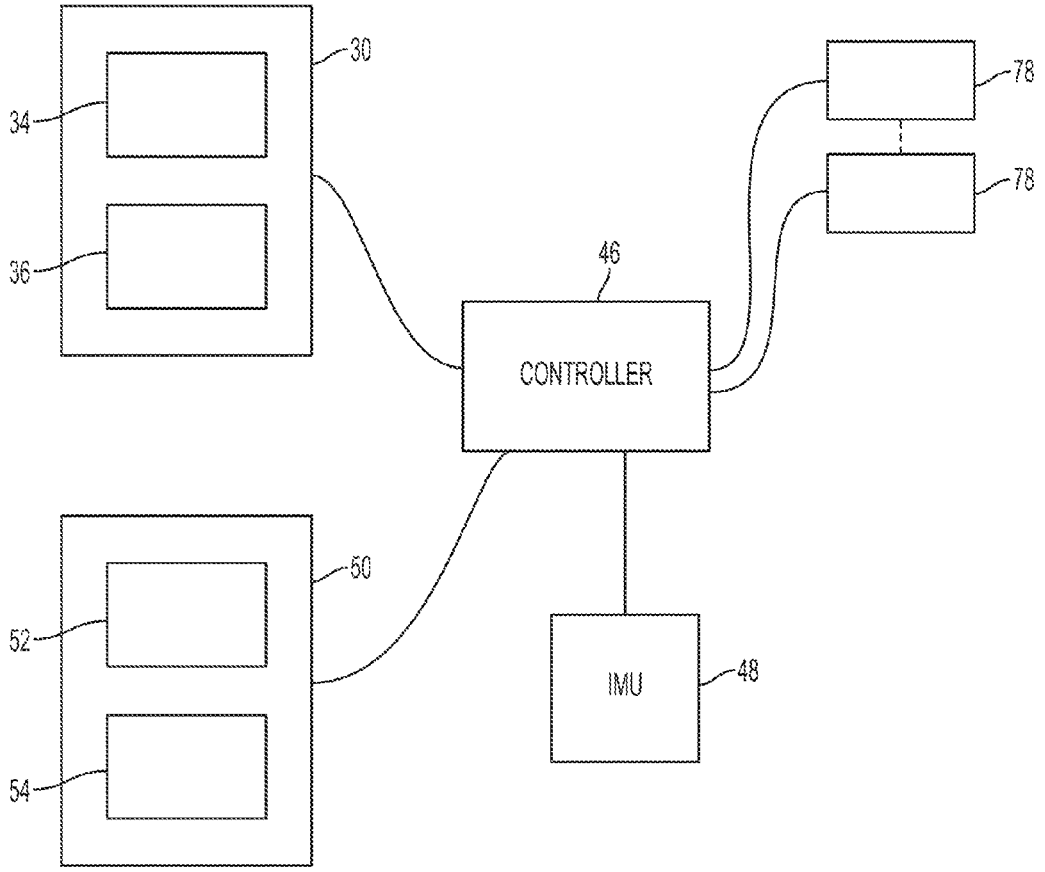
FIG. 12 is a schematic depicting a control system for the robot of FIG. 1, according to various embodiments of the present disclosure.

In various instances, a controller 46 can be configured to move the weight 40 through the cavity 32 by controlling the positions of the actuators 34 and 36. Referring to FIG. 12, the controller 46 can be in communication with the center of mass shifter assembly 30, such that the controller 46 can direct the actuation of the actuators 34 and 36. For example, the positions of the actuators 34 and 36 can be controlled by varying the frequency and relative phase of oscillatory movement of the two actuators 34 and 36. By controlling this movement in accordance with the particular weight distribution and shape configuration of the body 12 of the robot 10, the body 12 of the robot 10 may be made to move in a specified manner. For example, if the controller 46 directs the center of mass shifter assembly 30 to move and/or shift the center of mass of the robot 10 within the cavity 32, the base or posterior end 20 of the robot 10 can move and/or shift relative to the support surface (FIGS. 2 and 3), for example, which can cause the robot 10 to rock and/or pivot across the support surface 11.

For example, the controller 46 can direct the center of mass shifter assembly 30 to rock the body 12 of the robot 10 front-to-back, or side-to-side, or pivot around its posterior point of contact with the surface 11 (FIGS. 2 and 3) in an empirically determined manner. This rocking and pivoting can cause movement of the body 12 across the support surface (FIGS. 2 and 3). For example, if the body 12 rocks to the left, then pivots clockwise, then rocks to the right, and then pivots counterclockwise, the body 12 can move across a surface. As this pattern of movements repeats, the body 12 can continue to move across the surface. The direction, speed, and/or cadence of movement can be controlled by the controller 46, which is configured to issues commands to the dual, integrated actuators 34 and 36, for example. In at least one embodiment, the controller 46 can be implemented with an Arduino Uno microcontroller board with an Adafruit Motor Shield v2.3 (1438).

Figure 5:
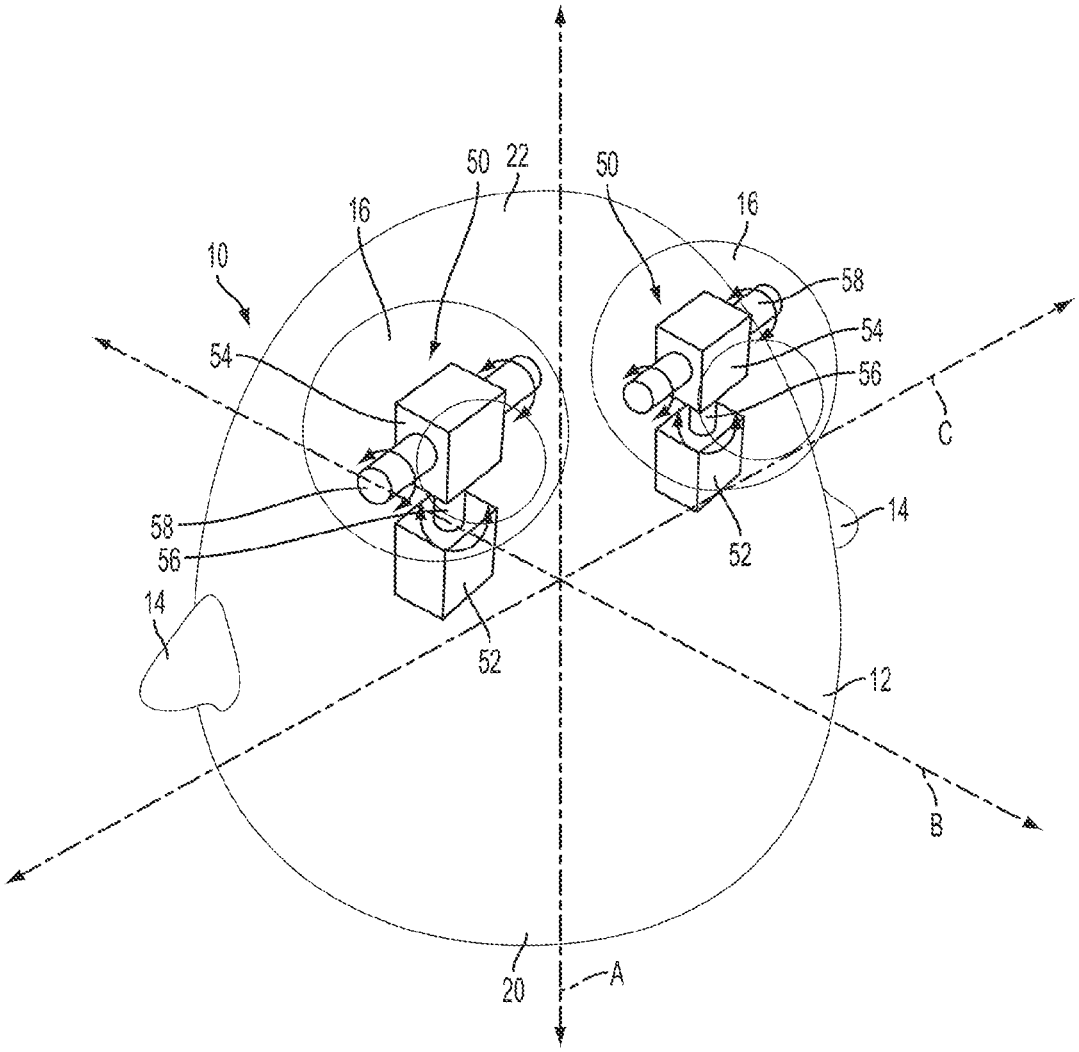
FIG. 5 is a perspective view of the robot of FIG. 1 with various elements shown in transparency and various elements removed for illustrative purposes, depicting an actuation system between each eye and the body of the robot, wherein the actuation system is configured to move each eye relative to the body, according to various embodiments of the present disclosure.

Referring now to the embodiment depicted in FIG. 5, in various instances, the robot 10 can include at least one eye actuation system 50. A system 50 can be positioned in each eye 16 of the robot 10, for example. The mechanisms 50 can be configured to move the eyes 16. For example, the eyes 16 can be configured to pan and/or tilt relative to the body 12 of the robot 10.

Figure 6:
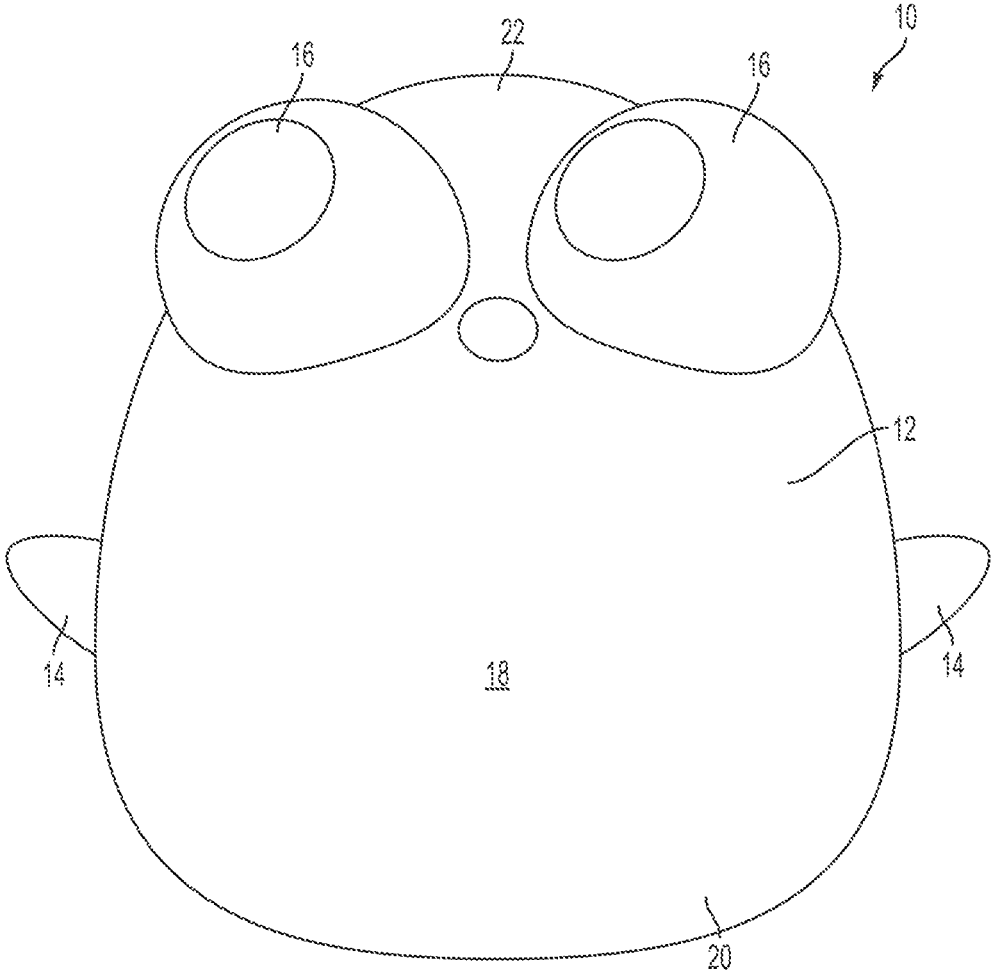
FIG. 6 is an elevation view of the robot of FIG. 1, depicting the eyes in a lifted orientation and the appendages in a raised orientation, according to various embodiments of the present disclosure.
Figure 7:
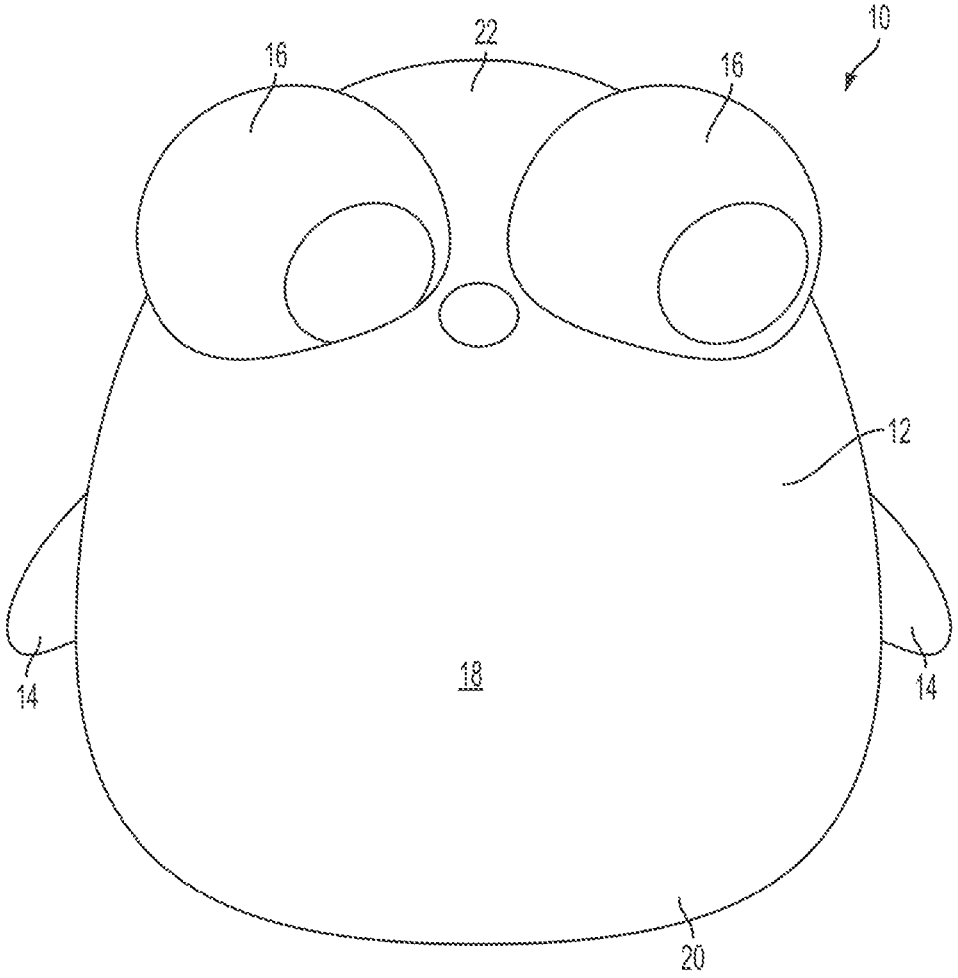
FIG. 7 is an elevation view of the robot of FIG. 1, depicting the eyes in a lowered orientation and the appendages in a depressed orientation, according to various embodiments of the present disclosure.

The systems 50 can each contain a first rotary motor or actuator 52 to control pan, e.g., side-to-side movement, and a second rotary motor or actuator 54 to control tilt, e.g., up and/or down movement, of the eyes 16 relative to the body 12 of the robot 10. For example, the first actuator 52 can be coupled to the body 12, the second actuator 54 can be coupled to the first actuator 52, and the eye 16 can be coupled to the second actuator 54 such that both actuators 52, 54 are intermediate the eye 16 and the body 12. The systems 50 can be configured to move the eyes 16 between a plurality of orientations, including a first orientation (FIG. 2), a lifted orientation (FIG. 6), and a lowered orientation (FIG. 7), for example.

Referring again to FIG. 5, a first output shaft 56 extends between the first actuator 52 and the second actuator 54. In such instances, the first actuator 52 is configured to control the position of the second actuator 54. For example, actuation of the first actuator 52 can rotate the first output shaft 56, which can affect rotation of the second actuator 54. For example, actuation of the first actuator 52 can rotate the second actuator 54 about an axis that is parallel to the anteposterior axis A, which can move the eye 16 along the lateral axis C and the dorsoventral axis B. As the eye 16 moves along the lateral axis C, the eye 16 can appear to pan across a scene, for example.

As depicted in FIG. 5, a second output shaft 58 extends between the second actuator 54 and the eye 16. Actuation of the second actuator 54 can rotate the second output shaft 58, which can affect rotation of the eye 16. For example, actuation of the second actuator 54 can rotate the second output shaft 58 and eye 16 coupled thereto about an axis that is parallel to the lateral axis C, which can move the eye 16 along the anteposterior axis A and the dorsoventral axis B. As the eye 16 moves along the anteposterior axis A, the eye can appear to tilt upward and/or downward, for example. Accordingly, the system of actuators 52 and 54 in each eye actuation system 50 can be configured to the eye 18 side-to-side, up, down, forward and/or backward relative to the body 12.

Referring again to FIG. 12, an inertial measurement unit (IMU) 48 can be positioned in the body 12 of the robot 10. In various instances, the inertial measurement unit 48 can provide a controller, such as the controller 46, with information about the rotation and/or movement of the body 12. In at least one embodiment, the inertial measurement unit 48 can be implemented with an L3DG20H gyroscope coupled to an LSM303DLHC accelerometer. The controller 46 can also be in communication with the eye actuation systems 50. In various instances, the pan and tilt actuators 52 and 54 in each eye 16 can be controlled in directions opposite to the detected rotation of the body 12. As a result, the eyes 16 can remain relatively stationary with respect to the world when the body 12 of the robot 10 moves. For example, the eyes 16 can remain fixed on an object as the body 12 of the robot 10 rotates and/or moves. In such embodiments, the eyes 16 of the robot 10 can remain stationary, or substantially stationary, as the body 12 of the robot 10 moves under its own power, as described herein, for example, and/or when the robot 10 is picked up and moved by an external force. For example, the eyes 16 of the robot 10 can remain fixed on an object and/or person as the robot 10 moves relative to the object and/or person.

Figure 8:
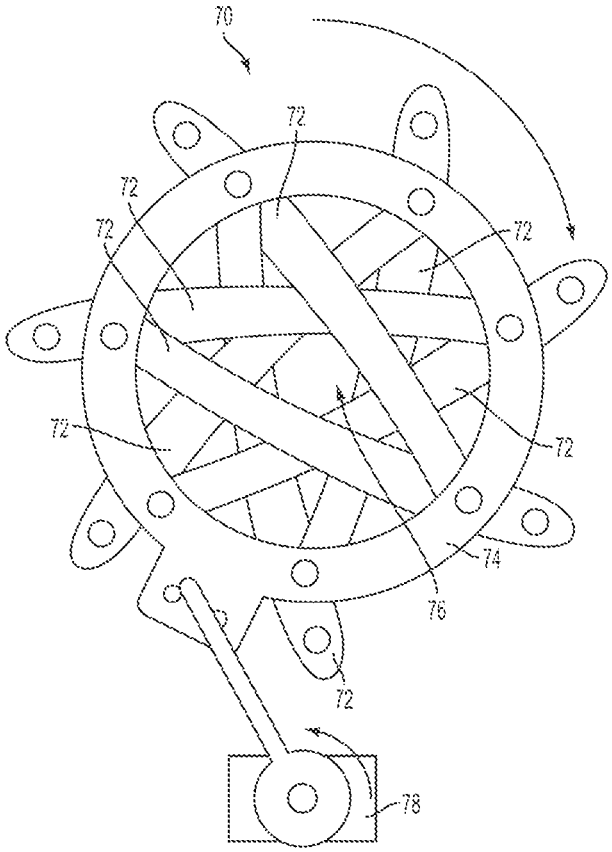
FIG. 8 is an elevation view of a mechanism for adjusting an aperture of an eye, depicting the mechanism in a first orientation corresponding to a smaller aperture of the eye, according to various embodiments of the present disclosure.
Figure 9:
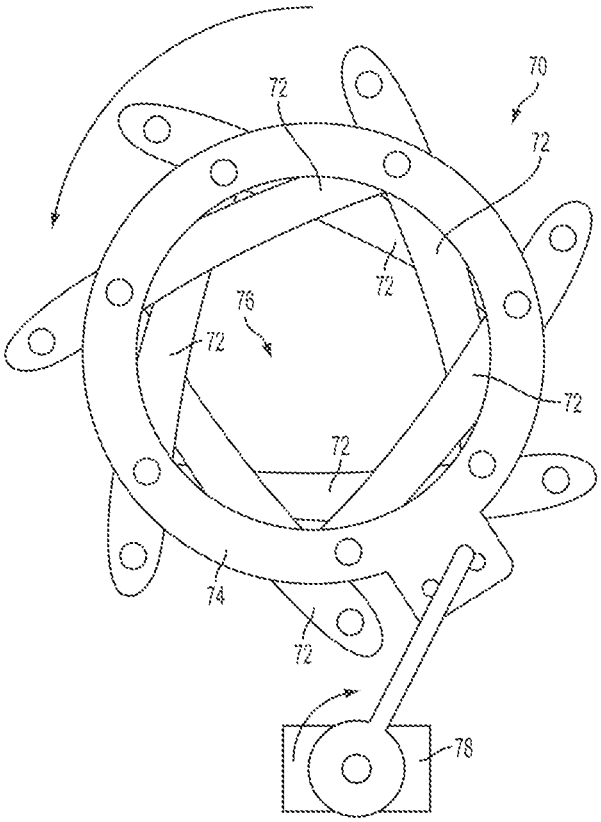
FIG. 9 is an elevation view of the mechanism of FIG. 8, depicting the mechanism in a second orientation corresponding to a larger aperture of the eye, according to various embodiments of the present disclosure.

In various instances, the eyes 16 can be configured to dilate and/or constrict to various sizes. For example, referring now to FIGS. 10 and 11, the eyes 16 can include pupils 60, and the size of the pupils 60 can be adjusted from a dilated configuration (FIG. 10) to a constricted configuration (FIG. 11). Referring now to FIGS. 8 and 9, a mechanism 70 for adjusting the size of each pupil 60 (FIGS. 1-5) is depicted. The mechanism 70 includes a plurality of concentrically-arranged blades 72 mounted to a frame 74. The blades 72 can form an aperture 76, which corresponds to the pupil 60. In various instances, the blades 72 can define a curvature and/or arc. The frame 74 can form a ring, for example, and one end of each blade 72 can be attached to the ring 74. In such instances, the other end of the each blade 72 can be free to shift relative to the ring 74.

Referring still to FIGS. 8 and 9, the mechanism 70 includes an actuator, such as a position-controllable motor 78. The positioned-controllable motor 78 can comprise a servo motor or a stepper motor, for example. The motor 78 can be configured to rotate the ring 74, and rotation of the ring 74 can shrink or enlarge the aperture 76 to change the size of the opening of the eye 15. For example, when the servo motor 78 rotates clockwise (FIG. 9), the ring 74 can be rotated counterclockwise and the aperture 76 can widen. Moreover, when the servo motor 78 rotates counterclockwise (FIG. 10), the ring 74 can be rotated clockwise and the aperture 76 can shrink.

Figure 10:
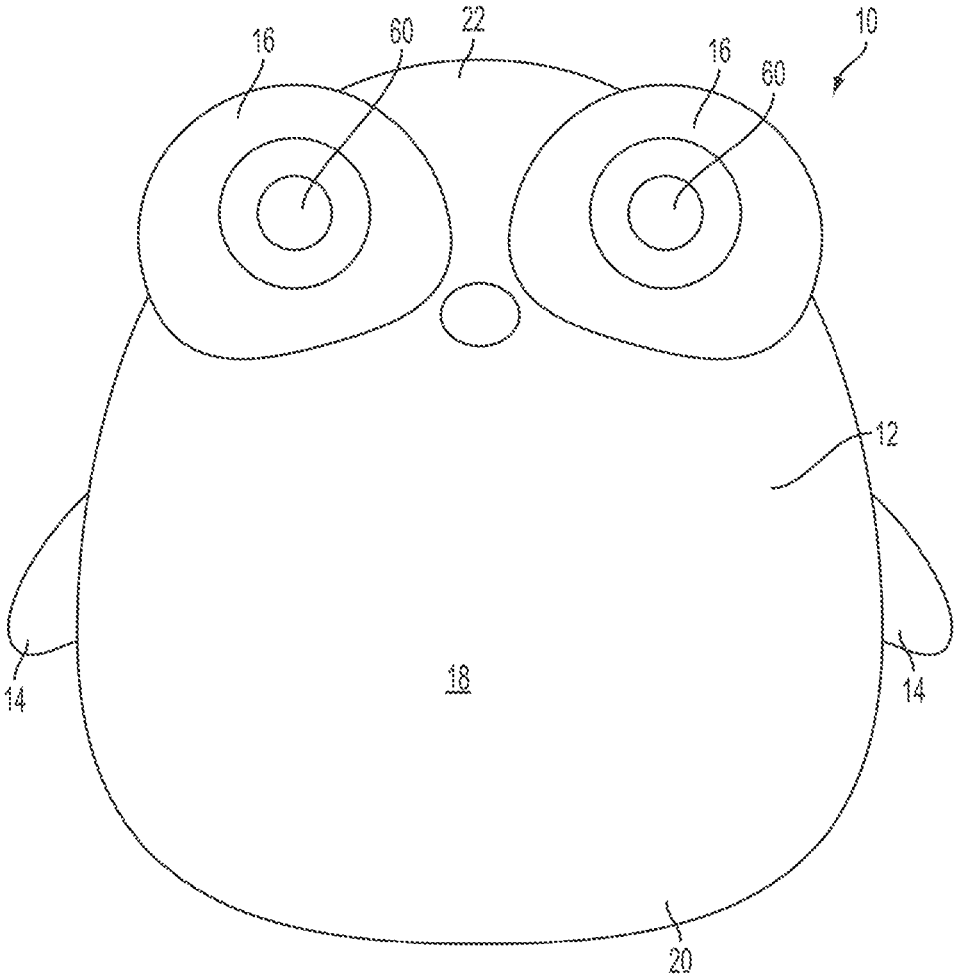
FIG. 10 is an elevation view of the robot of FIG. 1 depicting an aperture of each eye in a dilated configuration corresponding to the second orientation of the mechanism depicted in FIG. 9, according to various embodiments of the present disclosure.
Figure 11:
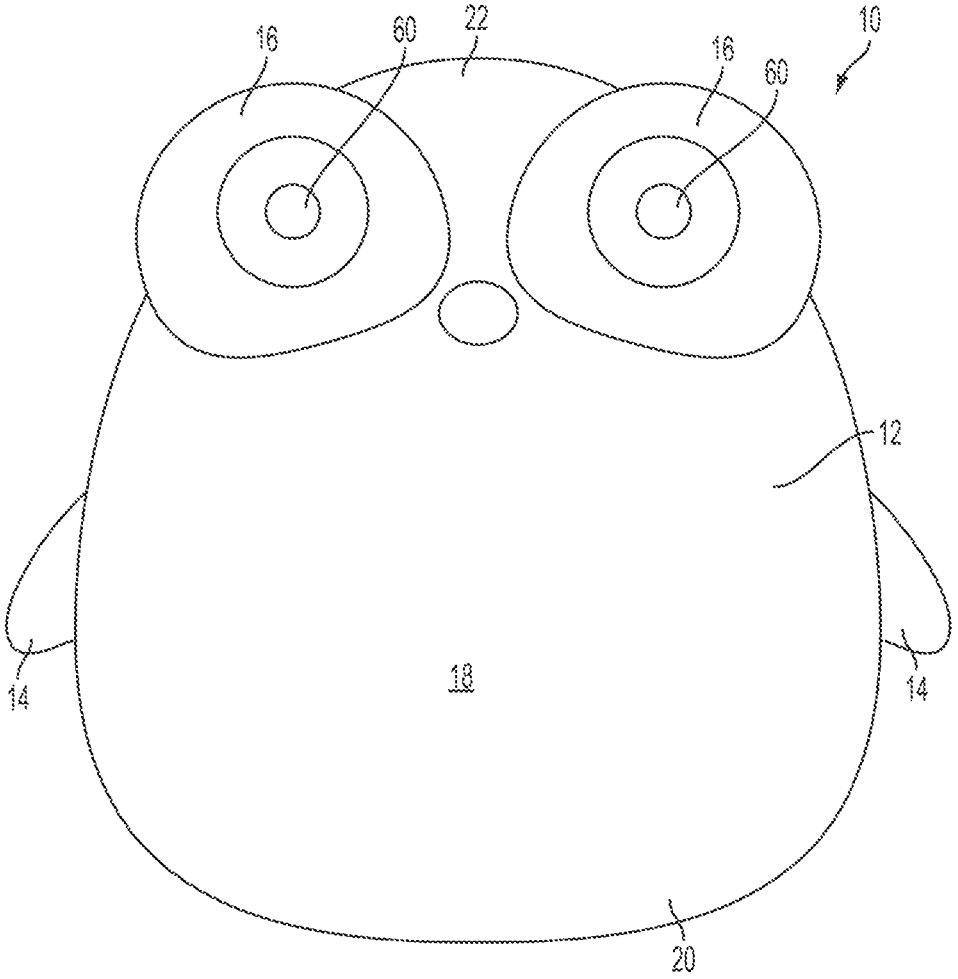
FIG. 11 is an elevation view of the robot of FIG. 1 depicting an aperture of each eye in a constricted configuration corresponding to the first orientation of the mechanism depicted in FIG. 8, according to various embodiments of the present disclosure.

Referring again to FIG. 12, a controller, such as the controller 46, for example, can be in communication with the actuator 78 for each pupil 60 (FIGS. 10 and 11). The controller 46 can control the degree and direction of rotation of the rings 74, which can control the size of the apertures 76. In various instances, the actuators 78 for each pupil 60 can be in communication with each other such that the size of the apertures 76 is uniform.

Referring again to FIGS. 1-7, 10 and 11, in various embodiments, the robot 10 can include protrusions or appendages 14, which can be arms or wings of a character, for example. The protrusions 14 can protrude from the left and/or right sides of the body 12 of the robot 10. In various instances, the protrusions 14 can be coupled to linear or rotary actuators, which can be controlled to move the protrusions 14 for expressive effect. For example, the controller 46 and information from the inertial measurement unit (IMU) 48 can be used to translate the protrusions 14 upward to a raised orientation (FIG. 6) and/or downward to a depressed orientation (FIG. 7) in a direction opposite to the rotation of the body 12 of the robot 10, which can give the appearance that the robot 10 is maintaining its balance.

While the present disclosure has been described as having certain designs, the various disclosed embodiments may be further modified within the scope of the disclosure. This application is therefore intended to cover any variations, uses, or adaptations of the disclosed embodiments using its general principles. Further, this application is intended to cover such departures from the present disclosure as come within known or customary practice in the relevant art.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

We claim:

1. A robotic toy, comprising:
- a body, comprising:
  - a housing;
  - a cavity defined within the housing; and
  - a contoured base;
- a driven pendulum assembly positioned within the cavity, wherein the driven pendulum assembly comprises:
  - a first actuator comprising a first output drive;
  - a second actuator coupled to the first output drive, wherein the second actuator comprises a second output drive positioned transverse relative to the first output drive; and
  - a weight coupled to the second output drive;
- a controller in communication with the first actuator and the second actuator;
- a movable eye; and
- an eye actuation system coupled to the movable eye, wherein the eye actuation system comprises:
  - a first eye actuator comprising a first eye output drive;
  - a second eye actuator coupled to the first eye output drive, wherein the second eye actuator comprises a second eye output drive, and wherein the second eye output drive is transverse to the first eye output drive.

2. The robotic toy of claim 1, wherein the controller is in communication with the first eye actuator and the second eye actuator.

3. The robotic toy of claim 2, further comprising an inertial measurement unit in communication with the controller, wherein the inertial measurement unit is configured to detect movement of the body in a first direction, and wherein the controller is configured to control the first eye actuator and the second eye actuator to move in a second direction opposite to the first direction.

4. The robotic toy of claim 1, wherein the first eye actuator comprises a first position-controllable motor, and wherein the second eye actuator comprises a second position-controllable motor.

5. The robotic toy of claim 1, wherein the movable eye further comprises:
- a ring;
- a plurality of blades, wherein each blade is mounted around the perimeter of the ring, and wherein an adjustable aperture is defined by the plurality of blades; and
- a motor coupled to the ring, wherein actuation of the motor is configured to pivot the ring.

6. The robotic toy of claim 1, wherein the first actuator is configured to rotate the second actuator about a first axis, and wherein the second actuator is configured to rotate the weight about a second axis.

7. The robotic toy of claim 6, wherein the first axis is perpendicular to the second axis.

8. The robotic toy of claim 6, wherein the weight is coupled to the second output drive by a u-shaped bracket.

9. The robotic toy of claim 1, wherein the driven pendulum assembly is suspended within the cavity.

10. The robotic toy of claim 1, wherein the first actuator comprises a first position-controllable motor, and wherein the second actuator comprises a second position-controllable motor.

11. A robot, comprising:
- a body comprising an inertial measurement unit, wherein the inertial measurement unit is configured to detect a direction of movement of the body;
- an eye movable relative to the body, wherein the eye comprises an actuation assembly comprising:
  - a first actuator comprising a first output drive;
  - a second actuator coupled to the first output drive, wherein the second actuator comprises a second output drive, and wherein the second output drive is transverse to the first output drive; and
- a controller in communication with the inertial measurement unit and the actuation assembly, wherein the controller is configured to control the actuation assembly to move the eye in the opposite direction of the direction of movement of the body detected by the inertial measurement unit.

12. The robot of claim 11, wherein actuation of the first actuator is configured to rotate the second actuator about a first axis, and wherein actuation of the second actuator is configured to rotate the weight about a second axis.

13. The robot of claim 12, wherein the first axis is perpendicular to the second axis.

14. The robot of claim 11, wherein the first actuator comprises a first servo motor, and wherein the second actuator comprises a second servo motor.

* * * * *